US005819413A

United States Patent [19]

Kerbrat

[11] Patent Number: 5,819,413

[45] Date of Patent: Oct. 13, 1998

[54] UNFOLDING DEVICE FOR RAZOR HANDLE

[75] Inventor: Renaud Kerbrat, Epron, France

[73] Assignee: Louisa Iberraken, wife Idiri, Paris, France

[21] Appl. No.: 775,686

[22] Filed: Dec. 31, 1996

[30] Foreign Application Priority Data

Jan. 4, 1996 [FR] France ..... 96 00046

[51] Int. Cl.[6] ..... B26B 21/52

[52] U.S. Cl. ..... 30/27; 30/526

[58] Field of Search ..... 30/32, 47, 526

[56] References Cited

U.S. PATENT DOCUMENTS

| | | | |
|---|---|---|---|
| 1,875,990 | 9/1932 | Christmas . | |
| 1,985,132 | 12/1934 | Woods | 30/47 |
| 2,075,007 | 3/1937 | Christmas | 30/47 |
| 2,407,516 | 9/1946 | Roberts | 30/47 |
| 2,699,602 | 1/1955 | Finley | 30/47 |
| 3,492,723 | 2/1970 | Mollica et al. | 30/47 |
| 3,703,765 | 11/1972 | Perez | 30/41 |
| 3,750,280 | 8/1973 | LePaliscot et al. | 30/47 |
| 3,879,844 | 4/1975 | Griffiths | 30/47 |
| 4,074,429 | 2/1978 | Roberts | 30/41 |
| 4,439,920 | 4/1984 | Nauheimer | 30/47 |
| 4,485,554 | 12/1984 | Bergamaschi | 30/47 |
| 4,712,301 | 12/1987 | Saito | 30/47 |
| 4,888,868 | 12/1989 | Pritchard | 30/41 |
| 4,985,994 | 1/1991 | Tavolieri | 30/47 |
| 5,274,922 | 1/1994 | Elliott | 30/47 |

FOREIGN PATENT DOCUMENTS

| | | |
|---|---|---|
| 2260927 | 5/1993 | United Kingdom . |
| WO90/11874 | 10/1990 | WIPO . |
| WO91/08088 | 6/1991 | WIPO . |
| WO95/10397 | 4/1995 | WIPO . |

*Primary Examiner*—Hwei-Siu Payer
*Attorney, Agent, or Firm*—Sughrue, Mion, Zinn, Macpeak & Seas, PLLC

[57] ABSTRACT

An unfolding device for forming, after unfolding, a razor handle having a head suitable for carrying a shaving cutting element, comprises:

(a) a first part and a second part connected to the first part by a pivot line;

(b) a retaining means designed to be at least partly destroyed, and (c) two folding lines each extending from an edge of the first part up to an edge of the second part, the said lines being at least partly curved in the first part and in the second part in order to form, after folding, two lateral skirtings.

20 Claims, 6 Drawing Sheets

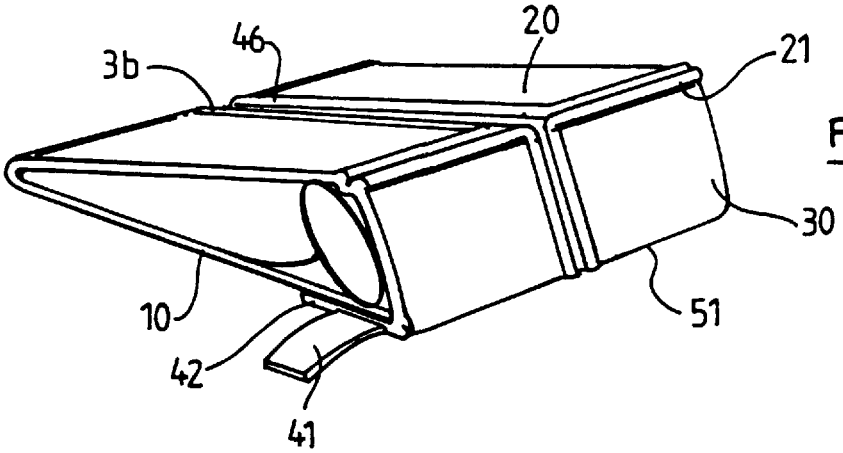
FIG. 1
FIG. 2
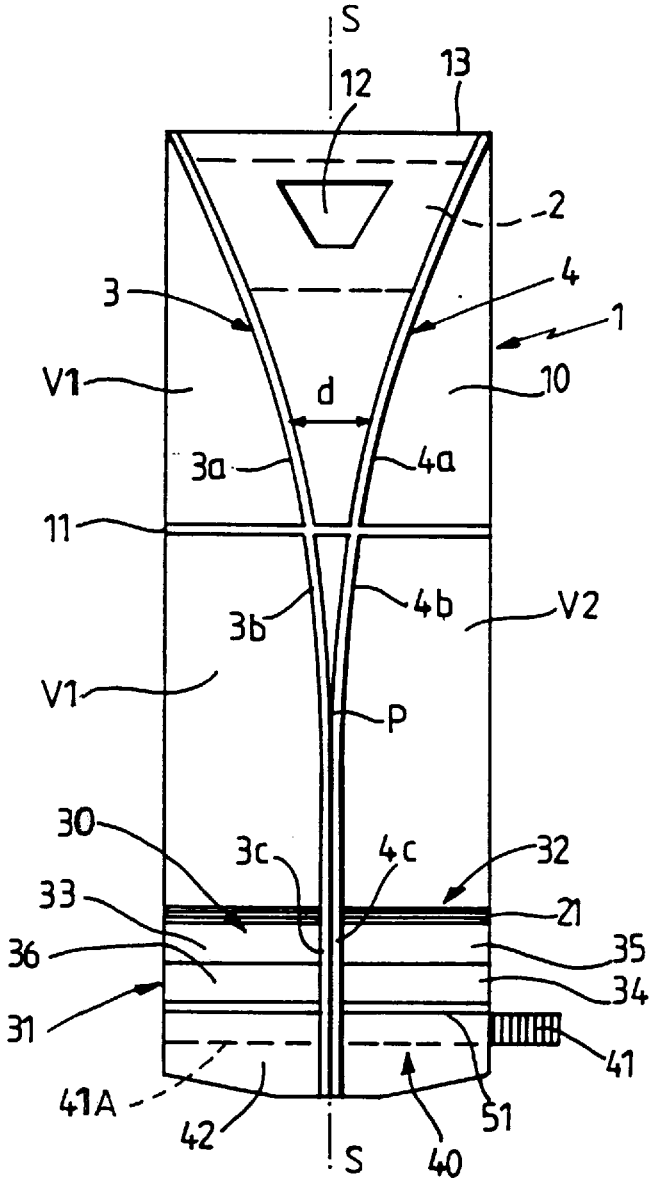

UNFOLDING DEVICE FOR RAZOR HANDLE

THE STATE OF THE ART

Folding disposable blade razors employing an articulated system are known. These known razors are made of a material that enables their reconditioning, and after reconditioning the user is not apt to determine whether or not the razor has already been used. Such reconditioning is a source of hygiene problems, of safety in use, of problems linked to the transmission of infectious diseases. . . .

Folding devices designed to form a razor handle are also known. The fold lines of known devices are all straight. After unfolding, the handle exhibits no curvature enabling a better cut.

SUMMARY OF THE INVENTION

This invention relates to a device suitable for forming, after unfolding, a handle for a cutting element, this device enabling to know whether the handle has already been used and therefore reconditioned, the said handle moreover having a curvature which facilitates the shaving operation and which increases the solidity of the handle notwithstanding the pivot line(s).

The device according to the invention is intended to form, after unfolding, a razor handle with a head suitable for attaching a shaving cutting element or bearing such a cutting element.

The device comprises:

(a) a first part, one end of which forms the head (said head being advantageously provided with a means for attaching the cutting element or bearing the cutting element);

(b) a second part connected to the first part by a pivot line;

(c) a retaining means intended to be at least partially destroyed, the said means prior to destruction preventing the pivoting of the first and second parts in relation to each other and after destruction enabling the pivoting of the first and second parts in relation to each other; and (d) a first folding line extending from an edge of the first part up to an edge of the second part, the said first line being at least partly curved in the first part and in the second part, and a second folding line extending from an edge of the first part up to an edge of the second part, the said second line being at least partly curved in the first part and in the second part. The said folding lines cross the pivot line at crossing points distant from each other, and define in the first and second parts a central face and two lateral skirtings. These lateral skirtings, after folding them in relation to the central face, form folded skirtings inclined in relation to the plane in which the head extends and ensure a curvature of the central face. This curvature facilitates the use of the handle and therefore the shaving operation, and increases the solidity of the handle, even if the latter is made of cardboard.

Advantageously, the first and second folding lines meet together in the second part, either at a single point, or to form only one single folding line after joining. Where they join, the folding lines are advantageously tangent in relation to each other.

Preferably, the first folding line and the second folding line, said lines extending each from an end edge of the first part up to an end edge of the second part are curved from the said end edge of the first part up to the said end edge of the second part.

According to one embodiment, the device comprises a first part, a second part and a third part, the second part being connected to the first part by a first pivot line, while the second part is connected to the third part by a second pivot line parallel to the first pivot line. According to this embodiment, the first folding line and the second folding line, which extend each from an end edge of the first part up to an end edge of the third part, are curved from the said end edge of the first part up to the said end edge of the third part, the said first and second folding lines crossing the first pivot line and the second pivot line at crossing points distant from each other.

Advantageously, for this embodiment, the retaining means extends, prior to its at least partial destruction, between the third part and the first part, so that, prior being unfolded, the device has the form of a folded volume part of triangular cross-section in a plane perpendicular to the pivot lines between the parts.

According to another embodiment, the device comprises a first part, a second part and a third part, the second part being connected to the first part by a first pivot line, while the second part is connected to the third part by a second pivot line parallel to the first pivot line, the first folding line and the second folding line, which extend from an end edge of the first part up to an end edge of the third part, being curved from the said end edge of the first part up to the first pivot line, and from the first pivot line up to the joining point of the first and second folding lines in the second part, the first and second folding lines after joining together in the second part forming one single straight folding line, the said first and second folding lines crossing the first pivot line at crossing points distant from each other.

Advantageously, the retaining means prior to its at least partial destruction extends between the third part and the first part, so that, prior being unfolded, the device exhibits the form of a folded volume part of triangular section in a plane perpendicular to the pivot lines between the parts.

According to a possible characteristic of this embodiment, when unfolding the device, the third part is folded prior to folding the lateral faces or skirtings in order after folding the lateral faces or skirtings to extend between these, one face of the said third part being folded on itself at the time of folding the lateral skirtings, the said face of the said third part bearing a means suitable for maintaining the face of the third part in its form folded over on itself and for maintaining the lateral faces or skirtings in folded form.

In a preferred device according to the invention, the first and second fold lines exhibit a curvature, on the one hand, between the end edge of the first part and the pivot line between the first and second parts, and, on the other hand, at least partly in the second part in the proximity of the pivot line between the first and second parts, the curvature exhibiting a first radius of curvature in the proximity of the end edge and a second radius of curvature in the proximity of the pivot line between the first and second parts, the said first radius of curvature being less than the said second radius of curvature. This ensures a more pronounced curvature in the proximity of the head and therefore in the proximity of the cutting element.

According to a feature of one embodiment, the lateral skirtings are provided with means for, after folding the lateral skirtings, maintaining the skirtings in folded form and for maintaining the curvature of the central face.

An example of retaining means intended to be at least partly destroyed is a strip intended to be at least partly torn, the said means prior to tearing preventing the pivoting of the first and second parts in relation to each other and after tearing enabling the pivoting of the first and second parts in relation to each other.

Advantageously, the device is made of a biodegradable material.

BRIEF DESCRIPTION OF THE DRAWINGS

FIG. 1 is a view in perspective of the folded-up razor;

FIG. 2 is a top view of the razor from FIG. 1 prior to being conditioned in its folded-up form and prior to being used;

DESCRIPTION OF PREFERRED EMBODIMENTS

Figure 4:
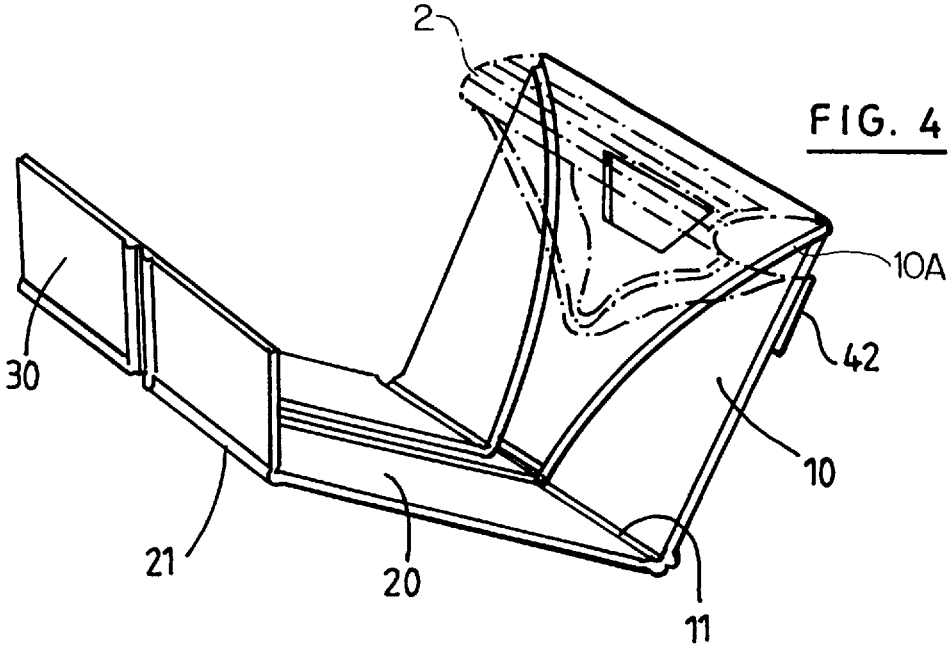
FIGS. 3 to 8 show the working (unfolding) of the razor from FIG. 1.

The razor comprises an unfolding device 1 and an element 2 bearing a cutting blade (shown in dashed-dotted lines in FIG. 2). This device is manufactured from a flat support in plastic (for example of thickness from 1 to 3 mm) or in plasticized cardboard (for example of thickness from 2 to 4 mm) exhibiting pivot lines or fold lines obtained by stamping, pressing, molding or by perforations. These lines therefore have for example the form of grooves, depressions, . . . The support can possibly be coated with a substance apt to change color when it comes into contact with water or a shaving cream. According to a possible variant, the support is provided with an adhesive patch apt to discolor or color.

The support with a substantially rectangular form comprises four parts 10, 20, 30, 40 connected to each other by pivot lines 11, 21, 51. The pivot lines are parallel to each other. The parts 10 and/or 20 can be provided with possible lateral flaps 100, 200 represented in dashed-dotted lines in FIG. 5. These lateral flaps are intended to close the sides of the device in folded-up position and are intended, when they are folded over on the lateral panels or skirtings V1, V2, to form a reinforcement for these panels (in order to give a greater rigidity to the whole).

The part 10 exhibits, in its head part 10A, a means 12 for attaching the cutting element 2 of the razor. In the form represented, said means 12 is an opening intended to receive a retaining device for the cutting element 2.

The part 30 has a layer of adhesive advantageously protected by a removable (for example peelable) protective strip. This layer of adhesive is located on the face of the support turned toward the head 10A, when the device is folded as shown in FIG. 1. Advantageously, the part 30 comprises two subparts 31, 32 intended to be applied against each other when using the razor. The subparts 31,32 each bear, on the one hand, a layer of adhesive 33, 34 partly covering the said subparts, and, on the other hand, a siliconized layer 35, 36 on which a layer of adhesive 33, 34 can be applied while enabling its removal. The layers 33, 34, 35, 36 are disposed in a manner such that, when the device is folded for use, a layer of adhesive of one subpart is applied on a siliconized layer of the other subpart.

The part 40 destined for retaining the device in closed position prior to use comprises a tearable strip 41 and a flap 42 attached to the part 40. This strip 41 is attached to the part 40 by two tear or rip lines 41A, the said lines 41A advantageously having a weakened area in order to facilitate the tearing off of the strip 41.

At the time of manufacturing the razor from FIG. 1, after placing the cutting element 2 on the head 10A, the part 10 is folded over toward the part 20 (pivoting round the line 11). Then, the part 30 is folded over toward the head 10A (pivoting round the line 21) and finally the part 40 is applied (pivoting round the line 51) and glued onto the back of the part 10 (face opposite to the one turned toward the head 10A bearing the cutting element 2).

After manufacture the razor is then in the folded form represented in FIG. 1, that is to say a form defining a volume of triangular section in a plane perpendicular to the pivot line 11.

The support also comprises folding lines 3, 4. The first, second and third parts 10, 20, 30 each comprise, on the one hand, a first folding line 3*a*, 3*b*, 3*c* extending from a pivot line up to an edge or between two pivot lines, and, on the other hand, a second folding line 4*a*, 4*b*, 4*c* extending from the pivot line up to an edge between two pivot lines. The first folding lines of the first, second and third parts are in the extension of each other in such a way as to define a continuous line, while the second folding lines of the first, second and third parts are in the extension of each other in such a way as to define a continuous line.

The first and second folding lines 3, 4 are distant from each other in the proximity of the pivot line 11 between the parts 10 and 20.

The first and second folding lines 3, 4 join up in the second part 20. From their joining point P to the end edge 13 of the part 10 the folding lines 3, 4 have a curved form. The distance "d" (measured parallel to the pivot line 11) between the folding lines 3, 4 increases from the point P towards the end edge 13 of the part 10. The point P is located substantially halfway between the lines 11 and 21.

The support comprises a line or plane of symmetry S between the folding lines 3, 4 ensuring after unfolding a symmetrical form in relation to a plane of the handle.

The use of the razor of FIG. 1 will now be described with reference to FIGS. 3 to 8.

Figure 3:
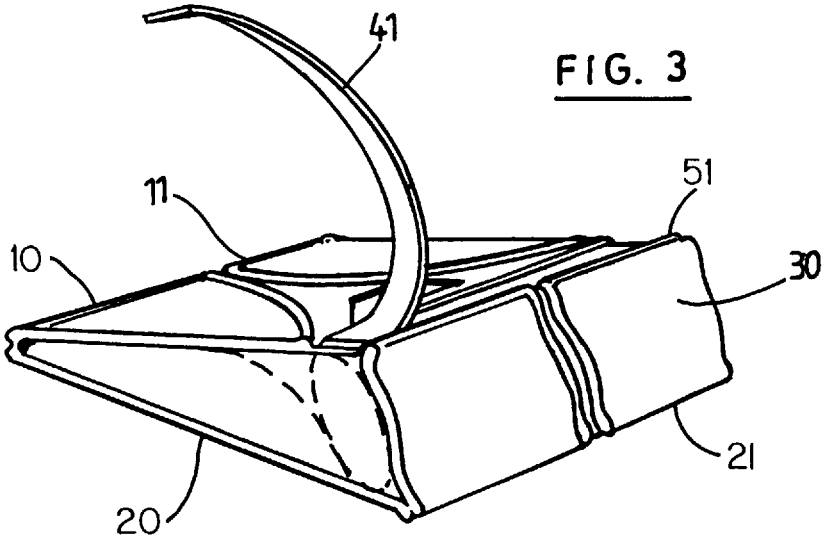

The strip 41 is torn off so that the parts 10, 20, 30 are apt to pivot round the lines 11, 21 (FIG. 3). When the strip is torn off, the part 42 remains attached to the part 10.

Figure 5:
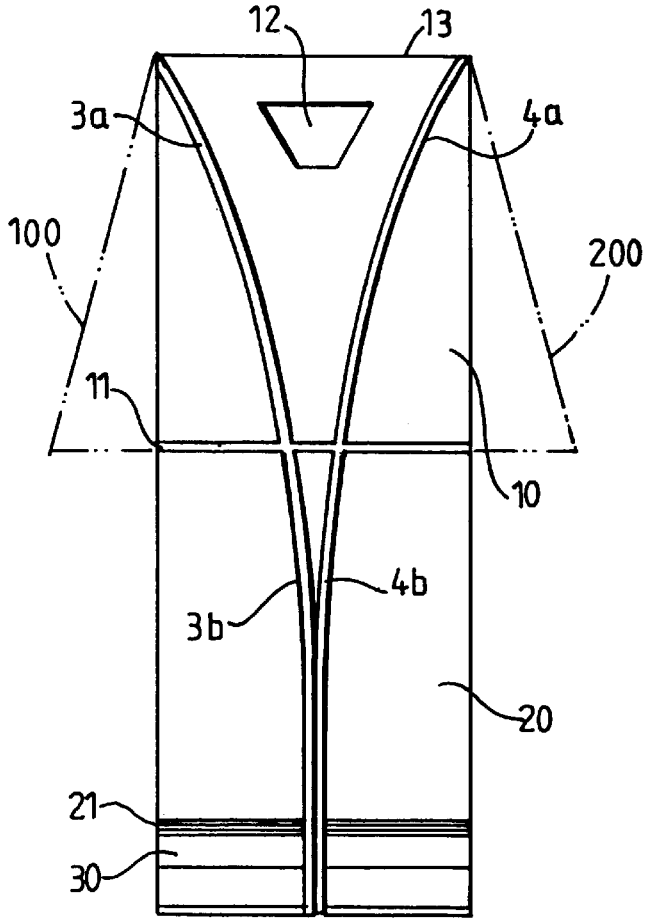

The parts 10, 20, 30 are then unfolded in order that they extend approximately in a same plane (FIGS. 4 and 5).

Figure 6:
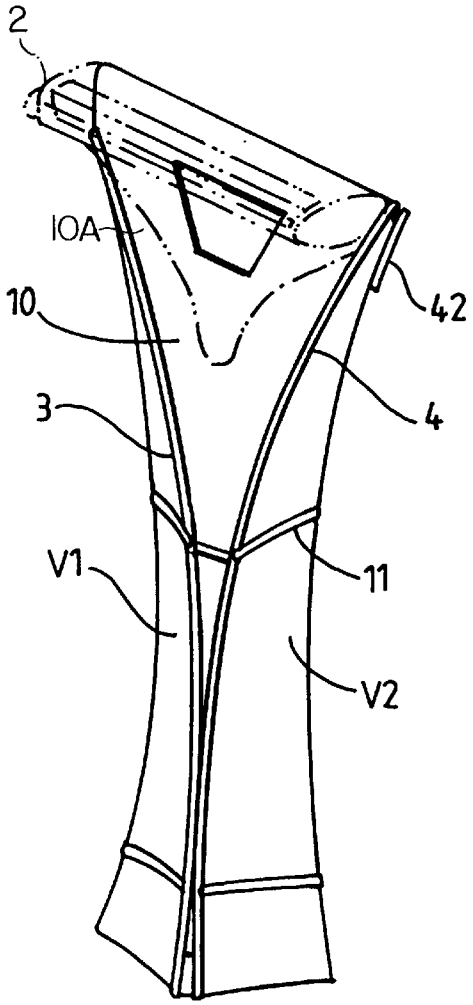
Figure 7:
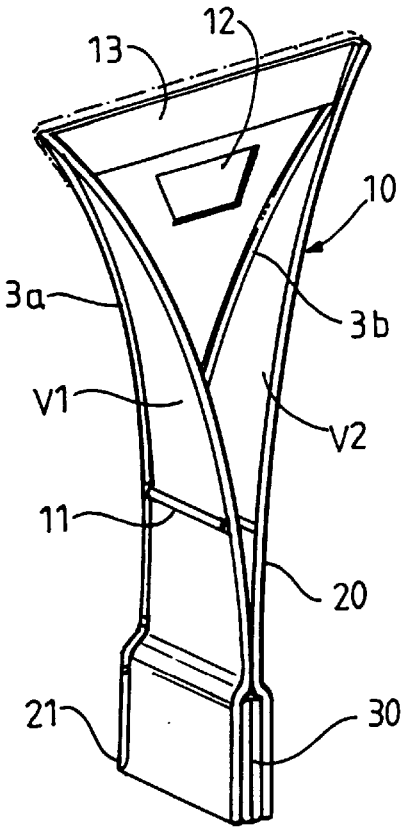

The part 30 is folded over (pivoting in relation to the line 21) onto the back of the part 20. The skirtings or lateral panels V1, V2 of the parts 10 and 20 located between, on the one hand, a folding line 3, 4 and, on the other hand, a lateral edge of the support 1 are folded in such a way as to bring at least partly the panels or the lateral edges thereof close together (FIGS. 6 and 7).

When the lateral panels or skirtings are partly against each other or substantially against each other, the subparts 31, 32 of the part 30 are applied against each together in such a way that a layer of adhesive 33, 34 rests on a siliconized layer 35, 36. These subparts form a spacer between the panels V1, V2 ensuring a greater rigidity to the handle at its free end opposite to that bearing the cutting element 2.

The razor exhibits a curved handle whose curvature is all the more accentuated in the proximity of the head 10A.

Figure 8:
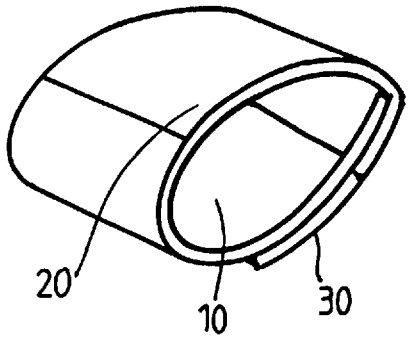

Once the razor has been used, it is possible to detach the panels V1, V2 from each other and to replace the parts 10, 20, 30 approximately in a same plane. Then, among others owing to a certain softening, it is possible to make a cylindrical form with the said parts, the head 10A and the cutting element 2 being placed in the interior volume defined by the cylindrical form. The part 30 is then applied against the back of the part 10 or 20 (in function of the rolling-up)

in such a way that the layers of adhesive 33, 34 prevent the razor from unrolling. These layers of adhesive are advantageously applied on a non-siliconized face or on a rough face in order to ensure an excellent adherence (FIG. 8).

Such a device, as shown in FIG. 1, enables a user to know that his razor is not a reconditioned razor, but also enables cuts to be avoided after use. Indeed, after using the razor, it is impossible to restore it to its original form and the cutting element is within the substantially cylindrical form obtained by rolling-up of the parts 10,20,30, whereby said cylindrical form prevent people to reach the cutting element.

Figure 9:
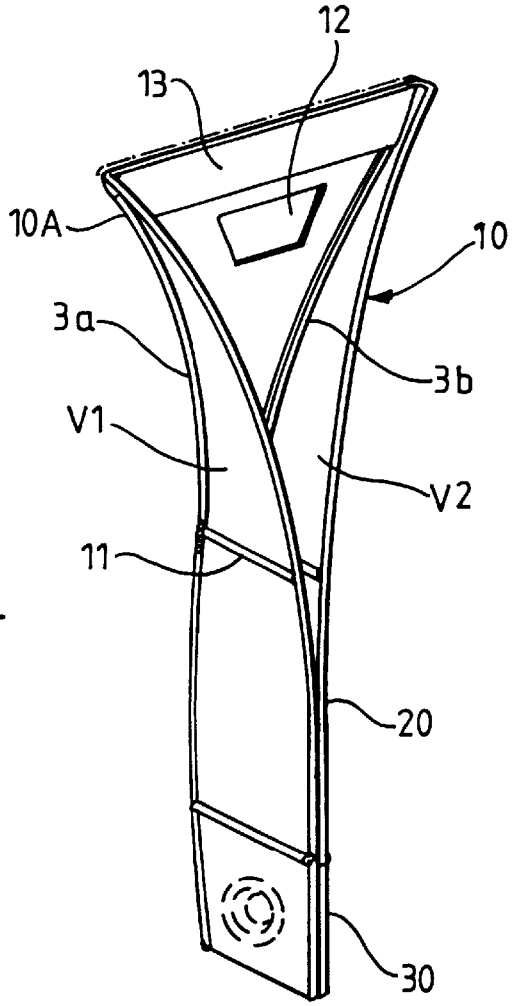
FIG. 9 shows a variant of the razor.

FIG. 9 shows a variant of a razor, in an unfolded position similar to that shown in FIG. 7. In this variant, the parts 31, 32 non-pivoted in relation to the line 51 are folded over against each other when the panels V1, V2 are brought close together. A male device and a female device (showed in dashed-line), respectively mounted on one of the parts 31, 32, enable, after clicking in, the device to be locked in its position for use.

Figure 10:
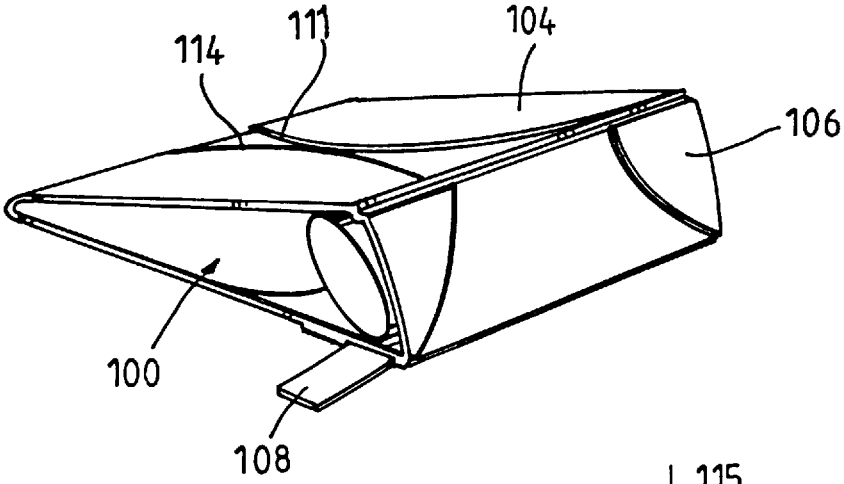
FIGS. 10 to 12 are views similar to those represented in FIGS. 1, 2 and 7, for another embodiment.
Figure 11:
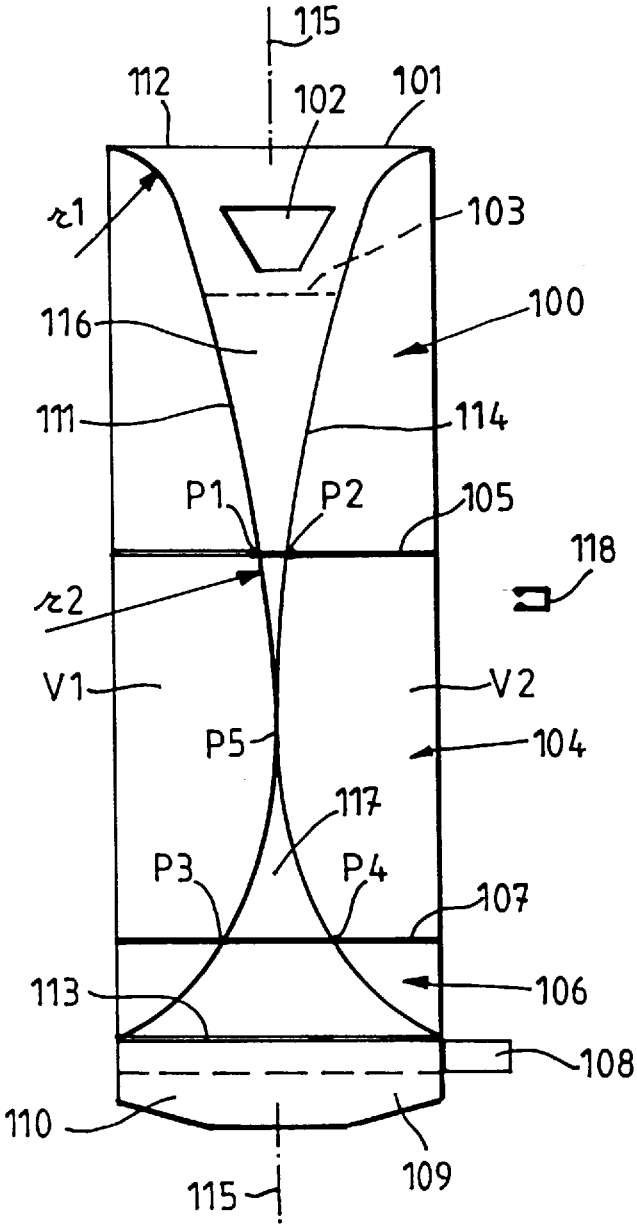
Figure 12:
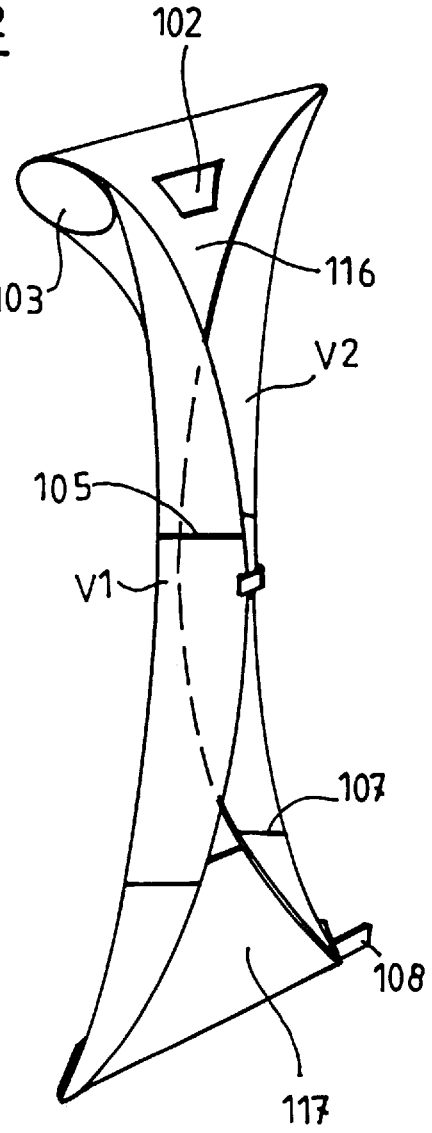

FIGS. 10 to 12 relate to another embodiment.

The device represented comprises:

(a) a first part 100 of which one end forms the head 101 exhibiting an opening 102 for the attachment of a cutting element 103;

(b) a second part 104 connected to the first part 100 by a pivot line 105;

(c) a third part 106 connected to the second part 104 by a pivot line 107;

(d) a retaining means or strip 108 intended to be torn off, the said means 108 being part of a flap 109 whose end 110 is glued onto the first part, the said means 108 prior to being torn off preventing the pivoting of the parts 100, 104, 106 in relation to each other, and, after tearing off, enabling the pivoting of the parts in relation to each other;

(e) A first folding line 111 extending from the upper edge 112 of the first part 100 up to the lower edge 113 of the third part 106, the said first line 111 being curved in the first part, in the second part and in the third part, and (f) A second folding line 114 extending from the upper edge 112 of the first part up to the lower edge 113 of the third part 106, the said second line being curved in the first part, in the second part and in the third part.

The pivot lines 105, 107 are parallel to each other. On the other hand, the folding lines 111, 114 are placed on both sides of a symmetry axis 115.

The folding lines 111, 114 cross the pivot lines 105, 107 at crossing points P1, P2, P3, P4 distant from each other. In the first, second and third parts these folding lines define an upper central face 116, a lower central face 117 and two lateral skirtings V1, V2. The two lateral panels or skirtings V1, V2, after folding them in relation to the central face, form folded panels or skirtings inclined in relation to the plane in which the head 101 extends and ensure a curvature of the upper central face 116. The first and second folding lines join together or touch together in the second part 104 at a point P5. Indeed, the folding lines are tangent to each other at point P5 (the tangent to the line 111 at point P5 and the tangent to the line 114 at point P5 correspond to the symmetry line 115).

In its folded form (see FIG. 10), the device prior to being unfolded exhibits the form of a volume part of triangular section in a plane perpendicular to the pivot lines 105, 107 between the parts.

The first and second folding lines 111, 114 exhibit a curvature, on the one hand, between the upper end edge 112 of the first part 100 and the pivot line 105 between the first and second parts, and, on the other hand, in the second part 104 in the proximity of the pivot line 105 between the first and second parts 100, 104. The curvature exhibits a first radius of curvature r1 in the proximity of the end edge 112 and a second radius of curvature r2 in the proximity of the pivot line 105 between the first and second parts, the said first radius of curvature r1 being less than the said second radius of curvature r2. For example, r2 is from 5 to 20 times greater than r1.

A clasp (or a clip) 118 can be used, after folding the lateral skirtings or panels, for enclosing two parts of these. After folding the lateral skirtings or panels, such a clasp or clip then serves as means for maintaining the skirtings or panels in folded form and therefore as means for maintaining the curvature of the upper central face 116.

The device according to the invention can be made of any material, but is preferably made of a degradable material or comprises an element made of a material which changes color when the device is used, preferably when the device is in contact with an aqueous medium. The device according to the invention can for example be made of cardboard, pasteboard materials, possibly provided with a plastic layer or coating, or of another material capable of softening in contact with water, in particular in contact with hot water. When the contact with water has been sufficient, the material will have become so soft that all further use of the handle will be impossible.

The use of the device, according to the invention, can only be achieved by carrying out the destructive action on the retaining system of the device in its folded position, in order to release the device and enable the handle to be obtained by a simple folding and/or pinching action. In this configuration the utilization of the handle, for example for shaving can be effected, but if inadvertently the handle or razor was not thrown away after use, as its use requires, anybody finding this will be able to see that this handle or razor has already been used. Indeed, by its conception it is no longer possible for a user to refold and reclose the device in order to restore its appearance prior to its utilization. Whatever the circumstances, the retaining system to be destroyed is itself sufficient to warn any user of the reutilization of the handle or razor. By the arrangement of the parts of the device and/or of materials used, the handle will not be able to be refolded into its initial position and remain there. As the retaining device of the body in folded position has been destroyed in order to permit its utilization, it is no longer possible for any individual, even ill-intentioned, to reclose the device in its initial unused state. Such a device enables the limitation of all the risks of contamination by infectious diseases by the reutilization of shaving systems whose blades could have been infected by previous use.

What I claim is:

1. Device, after assembled, forming a razor handle exhibiting a head suitable for bearing a shaving cutting element, said head extending in a plane, this device comprising:

(a) an element extending between a first end edge forming the head of the handle and a second end edge opposite to said first end edge, said element consisting of a first part, a second part connected to the first part by a first pivot line, and a third part connected to the second part by a second pivot line, the said second pivot line being parallel to the first pivot line, the said first part extending between the first end edge, two opposite lateral edges and the first pivot line, the second part extending between two opposite lateral edges, the first pivot line and the second pivot line, while the third part extends between two lateral edges, the second pivot line and the second end edge;

(b) a retaining means destined to be at least partly destroyed, the said means prior to destruction linking the first part with the third part for preventing the pivoting of the first and second parts in relation to each other at the first pivot line, as well as the pivoting of the second and third parts in relation to each other at the second pivot line, and after destruction enabling the pivoting of the first and second parts in relation to each other at the first pivot line, as well as the pivoting of the second and third parts in relation to each other at the second pivot line; and (c) a first folding line extending through the first part, the second part and the third part from an edge of the first part up to an edge of the third part, the said first folding line being at least partly curved in the first part and in the second part, while said first folding line is straight partly in the second part and in the third part, and (d) a second folding line extending through the first part, the second part and the third part from an edge of the first part up to an edge of the third part, the said second line being at least partly curved in the first part and in the second part, while said second folding line is straight partly in the second part and in the third part, in which the said folding lines cross the first pivot line at crossing points distant from each other and the second pivot line at a same crossing point, the said folding lines defining a central portion extending in the first part and in the second part and two lateral skirtings extending in the first and second parts after the pivoting of the third part on the second part, in which, after pivoting the third part on the second part and after folding said lateral skirtings in relation to the central portion so that the third part is folded on itself, the said lateral skirtings form folded skirtings inclined in relation to the plane in which the head extends, said inclined skirtings which ensure a curvature of the central portion extending between the head and the crossing point of the first and second folding lines with the second pivot line, with portions contacting each other and with portions distant from each other at the head and at the crossing point of the first and second folding lines with the second pivot line so as to increase the rigidity of the razor handle.

2. Device according to claim 1, in which the retaining means prior to its at least partial destruction extends between the third part and the first part, so that prior to being assembled the device exhibits the form of a folded volume part of triangular section in a plane perpendicular to the pivot lines between the parts.

3. Device according to claim 8, in which the head bears a cutting element, said cutting element, prior to the destruction of the retaining means, being within the said folded volume part defined by the said first part, said second part and said third part.

4. Device according to claim 1, in which the third part has a first face and a second face opposite to said first face, the said third part being pivoted on the second part so that said first face of the third part contacts the second part, while, after folding the lateral skirtings, the second face of the said third part is folded on itself, the said second face of the said third part being provided with a means for maintaining the second face of the third part in its form folded over on itself and for maintaining the lateral skirtings in folded form.

5. Device according to claim 1, in which the first and second folding lines exhibit a curvature, on the one hand, between the first end edge and the first pivot line, and, on the other hand, at least partly in the second part in the proximity of the first pivot line, the curvature exhibiting a first radius of curvature in the proximity of the first end edge and a second radius of curvature in the proximity of the first pivot line, the said first radius of curvature being less than the said second radius of curvature.

6. Device according to claim 1, in which the lateral skirtings are provided with means for, after folding the lateral skirtings, linking the skirtings together so as to maintain the skirtings in folded form, as well as the curvature of the central portion.

7. Device according to claim 1, in which the retaining means destined to be at least partly destroyed is a strip adapted to be at least partly torn, said retaining means, prior to tearing, preventing the pivoting of the first and second parts in relation to each other, as well as the pivoting of the third part in relation to the second part, and, after tearing, enabling the pivoting of the first and second parts in relation to each other, as well as the pivoting of the third part in relation to the second part.

8. Device according to claim 1, which is made of a biodegradable material.

9. Device according to claim 1, in which the head exhibits a means of attachment for a cutting element.

10. Device according to claim 1, in which the first and second folding lines join together in the second part at a joining point for forming from said joining point up to the second end of the third part a single folding line.

11. Device according to claim 1, in which the first and second pivot lines are parallel to each other, so that prior to the destruction of the retaining means, the first part, the second part and the third part define a volume with a triangular cross section.

12. Device, after assembled, forming a razor handle exhibiting a head suitable for bearing a shaving cutting element, said head extending in a plane, this device comprising:

(a) an element extending between a first end edge forming the head of the handle and a second end edge opposite to said first end edge, said element consisting of a first part, a second part connected to the first part by a first pivot line, and a third part connected to the second part by a second pivot line, the said second pivot line being parallel to the first pivot line, the said first part extending between the first end edge, two opposite lateral edges and the first pivot line, the second part extending between two opposite lateral edges, the first pivot line and the second pivot line, while the third part extends between two lateral edges, the second pivot line and the second end edge;

(b) a retaining means destined to be at least partly destroyed, the said means prior to destruction linking the first part with the third part for preventing the pivoting of the first and second parts in relation to each other at the first pivot line, as well as the pivoting of the second and third parts in relation to each other at the second pivot line, and after destruction enabling the pivoting of the first and second parts in relation to each other at the first pivot line, as well as the pivoting of the second and third parts in relation to each other at the second pivot line; and (c) a first folding line extending through the first part, the second part and the third part from an edge of the first part up to an edge of the third part, the said first folding line being curved in the first part, in the second part and in the third part, and (d) a second folding line extending through the first part, the second part and the third part from an edge of the first part up to an edge of the third part, the said first folding line being curved in the first part, in the second part and in the third part, in which the said folding lines cross the first pivot line at crossing points distant from each other and the second pivot line at crossing points distant from each other, the said folding lines defining therebetween a central portion extending in the first part and in the second part and two lateral skirtings extending in the first part, in the second part and in the third part, in which the said lateral skirtings, after folding them in relation to the central portion, form folded skirtings inclined in relation to the plane in which the head extends and ensuring a curvature of the central portion, said folded skirtings extending between the head and the second end edge of the element, with portions distant from each other at the head and at the crossing points of the first and second folding lines respectively with the first pivot line and the second pivot line so as to increase the rigidity of the razor handle.

13. Device according to claim 12, in which the first folding line joins the second folding line in the second part.

14. Device according to claim 12, which is made of a biodegradable material.

15. Device according to claim 12, in which the head exhibits a means of attachment for a cutting element.

16. Device according to claim 12, in which the first folding line joins the second folding line in the second part, and in which the retaining means prior to its at least partial destruction extends between the third part and the first part, so that prior to being assembled, the device exhibits the form of a folded volume part of triangular section in a plane perpendicular to the pivot lines between the parts.

17. Device according to claim 16, in which the lead head a cutting elements, said cutting element, prior to the destruction of the retaining means, being within the folded volume part defined by the said first part, second part and third part.

18. Device according to claim 12, in which the first and second folding lines exhibit a curvature with a first radius at the first end edge and a curvature with a second radius at the first pivot line, the said first radius of curvature being less than the said second radius of curvature.

19. Device according to claim 12, in which the lateral skirtings are provided with means for, after folding the lateral skirtings, linking the skirtings together so as to maintain the skirtings in folded form, as well as the curvature of the central portion.

20. Device according to claim 19, in which the retaining means destined to be at least partially destroyed is a strip destined to be at least partly torn, the said means, prior to tearing, preventing the pivoting of the first and second parts in relation to each other, as well as the pivoting of the third part in relation to the second part, and, after tearing, enabling the pivoting of the first and second parts in relation to each other, as well as the pivoting of the third part in relation to the second part.

* * * * *